United States Patent [19]

Knox

[11] 4,241,745

[45] Dec. 30, 1980

[54] LIGHTWEIGHT, PORTABLE SHELTER FOR BACKPACKERS

[76] Inventor: Edward L. Knox, 501 NW. 9th St., Bentonville, Ark. 72712

[21] Appl. No.: 71,686

[22] Filed: Aug. 30, 1979

[51] Int. Cl.[3] ..... E04B 1/343

[52] U.S. Cl. ..... 135/1 R; 135/4 C; 52/71

[58] Field of Search ..... 52/70, 71, DIG. 10; 135/1 R, 4 R, 1 C, 4 C

[56] References Cited

U.S. PATENT DOCUMENTS

| | | | |
|---|---|---|---|
| 2,835,931 | 5/1958 | Sterkin | 52/70 |
| 3,738,023 | 6/1973 | Sajkovic | 52/DIG. 10 |
| 3,759,277 | 9/1973 | Glade | 135/4 R |
| 3,785,066 | 1/1974 | Juitt | 52/DIG. 10 |
| 3,807,104 | 4/1974 | Webster | 52/71 |
| 4,064,662 | 12/1977 | O'Toole | 52/71 |
| 4,133,149 | 1/1979 | Angress | 52/70 |
| 4,145,850 | 3/1979 | Runyon | 52/71 |

FOREIGN PATENT DOCUMENTS

| | | | |
|---|---|---|---|
| 102135 | 11/1916 | United Kingdom | 135/1 C |
| 958491 | 5/1964 | United Kingdom | 52/71 |

*Primary Examiner*—J. Karl Bell

*Attorney, Agent, or Firm*—Clarence A. O'Brien; Harvey B. Jacobson

[57] ABSTRACT

The shelter is produced of a semi-rigid foldable material and can be rolled up into a compact configuration which is easy to carry. In its erect configuration, the shelter includes a generally conically shaped top covering which is connected to a triangular base. Connected to the base is a partial flooring which extends between two corners of the triangle. The occupant enters below the covering through the open floor section and places his weight on the enclosed floor section. This holds the three corners of the triangle downwardly thus causing the covering of the shelter to maintain its vertical disposition. The weight of the occupant causes the shelter to maintain a conical shape. Internal stake loops are attached at each end of the opening in the floor to allow adjustment of the shelter ground contact to seal the opening.

9 Claims, 8 Drawing Figures

LIGHTWEIGHT, PORTABLE SHELTER FOR BACKPACKERS

BACKGROUND OF THE INVENTION

1. Field of the Invention

This invention relates to collapsible shelters and especially to such shelters which are adapted for use by backpackers in that they are easily erected and collapsed and light enough in weight to be carried.

2. Description of Related Art

Shelters for hikers and other outdoor enthusiasts have undergone a great evolution in the past. Initially, such shelters took the form of canvas tents which required heavy, bulky internal frameworks which had to be carried along with the tent and a plurality of stakes and guy wires which were used for holding the tent in place. Soon, tents were erected using external frames in order to speed the process. Materials were changed from canvas and steel to such materials as nylon and aluminum in order to greatly reduce the size and weight of the tents. While such improvements greatly enhance the allure of the outdoors by providing a tent which is more easily erected and collapsed, there still has been felt a need for a shelter which can be used by a hiker for providing immediate shelter from the elements in the case of an unexpected downpour, etc.

One attempt at providing such a shelter is shown in U.S. Pat. No. 4,064,662, issued Dec. 27, 1977, to O'Toole. The O'Toole patent shows a collapsible tetrahedral structure which is erectable from a single blank and collapsible to a relatively small, compact and transportable size. The structure when collapsed can be folded by folds and bifurcations to have an area one-fourth the area of the blank from which the structure is made.

SUMMARY OF THE INVENTION

One object of the present invention is to provide a lightweight, portable shelter for backpackers which can be easily collapsed into a compact configuration and carried on a backpack.

A further object of the present invention is to provide a lightweight, portable shelter for backpackers which has a self-supporting shell of semi-rigid material requiring no poles or other framework for support.

A still further object of the present invention is to provide a lightweight, portable shelter for backpackers which can be erected instantly and is held in place by the body weight of the user or users.

One more additional object of the present invention is to provide a lightweight, portable shelter for backpackers which can be used either in the erect configuration for a shelter or can be used while folded flat to provide a cushion to sleep on during clear weather conditions.

An even still further object of the present invention is to provide a lightweight, portable shelter for backpackers which uses no entry flaps thereby eliminating the need for zippers, ties, or other leak prone attachment devices.

In accordance with the foregoing objects, the shelter of the present invention includes a generally cone-shaped top which has a generally triangular base. The cone top is formed from a rectangular section of shape sustaining material by cutting a V in one of the longer sides of the rectangle and adjoining the legs of the V together. A floor is also cut from the same material and is produced in a trapezoidal shape with the longer base of the trapezoid equal to the longitudinal dimension of the rectangular section. The floor is attached to the base of the dome top with the longer base connected to the two corners of the original rectangular section and the shorter base attached to points extending along two sides of the triangular base. This leaves one portion of the base open to act as an entry. Stake loops can be attached to the floor at the ends of the shorter trapezoidal base. Further, a small ventilation hole can be formed in the apex of the conical dome to provide adequate ventilation. The entire shelter can be formed from one-quarter inch thick closed cell polyethylene foam. This material is sturdy enough to maintain the shelter shape with an occupant or occupants within it, yet allows the shelter to be folded and rolled into a compact configuration.

These together with other objects and disadvantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
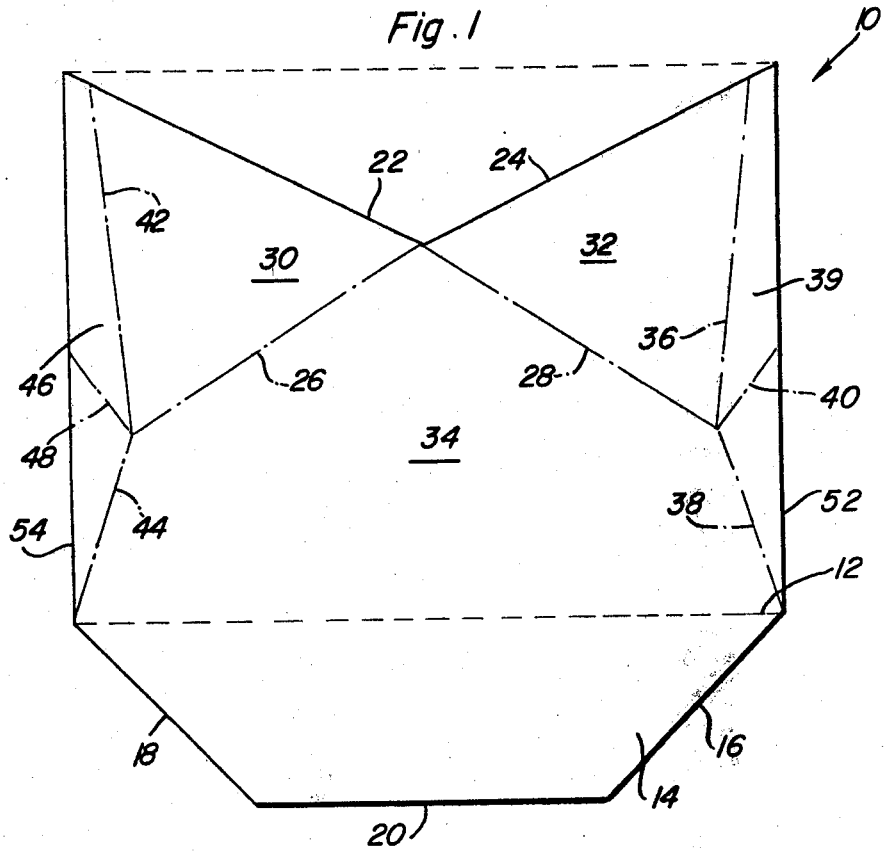
FIG. 1 shows a planar section of material with appropriate fold lines marked for producing the shelter of the present invention.
Figure 2:
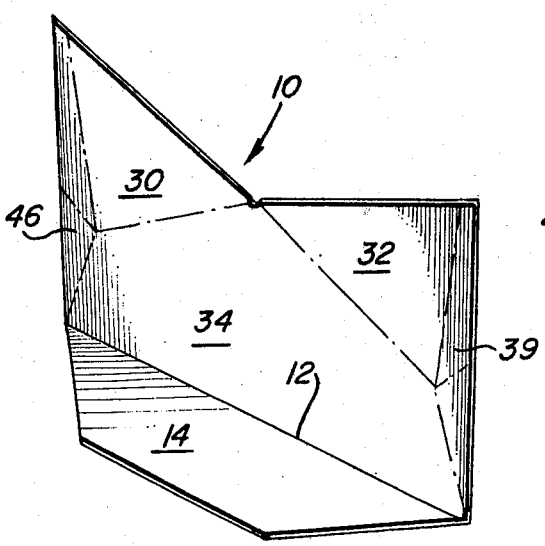
FIG. 2 shows a first step in the folding process by which the shelter may be formed.
Figure 3:
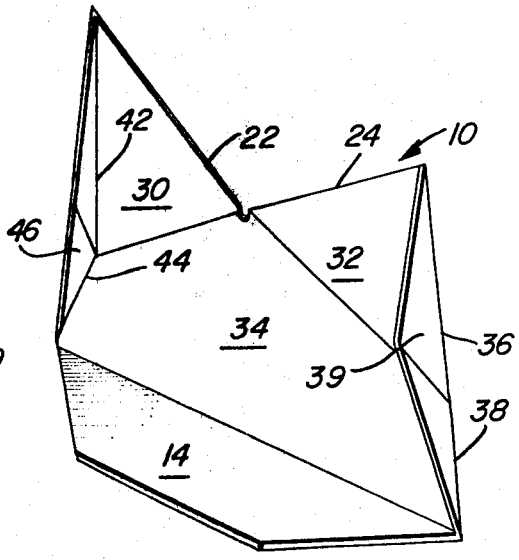
FIG. 3 shows a second step in the folding process by which the shelter may be formed.
Figure 4:
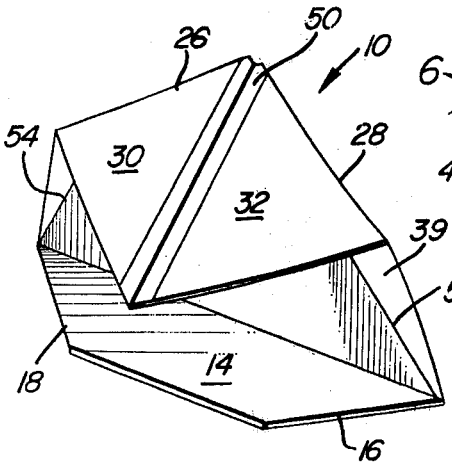
FIG. 4 shows a third step in the folding process by which the shelter may be formed.

Now with reference to the accompanying drawings, a lightweight, portable shelter for backpackers incorporating the principles and concepts of the present invention and generally referred to by the reference numeral 10 will be described in detail. With particular reference to FIG. 1, there will be seen a planar section of material from which the shelter is to be produced. The material itself should be a light, semi-rigid, flexible shape sustaining material. Preferably the shelter should be produced from one-quarter inch thick closed cell polyethylene foam. However, other materials may suffice. Ideally, the material should have the qualities of polyethylene foam but allow breathability. In FIG. 1, it will be seen that the material is divided into two sections by fold line 12 which separates a trapezoidal floor section 14 which has side edges 16 and 18 and a minor base 20 from the remainder of the material. The remainder of the material can be seen to be generally rectangular in shape with a V-notch having sides 22 and 24 cut therein opposite the floor 14. The apex of the V is positioned in the longitudinal center of the rectangular section and about one-third of the distance from one side to the other toward the floor 14. A pair of fold lines 26 and 28 radiate outwardly from the apex of the V and serve to define, together with sides 22 and 24 of the V, the front portions 30 and 32 and the back 34 of the top conical portion. Along the end of the rectangular portion are additional fold lines which define marginal flanges for the shelter base when it is erected. These fold lines constitute lines 36 and 38 on the right side of FIG. 1. Lines 36 and 38 slope inwardly of the rectangular portion and meet fold line 28 to define a marginal portion 39. Marginal portion 39 is separated by an additional fold line 40 which starts at the intersection of lines 28, 36 and 38 and slopes toward the right of the drawing and toward the side of the rectangular portion containing the V notch. Fold lines 42 and 44 are seen to be connected in the left hand portion of the drawing with fold line 26 defining a marginal portion 46. An additional fold line 48 slopes away from the intersection of lines 42, 44 and 26 in a manner symmetrical to that of line 40. FIG. 2 shows the shelter taking shape by first folding a floor sectión 14 back along fold line 12. Next, as shown in FIG. 3, the marginal sections 39 and 46 are folded in the direction of the floor 14 along lines 36, 38, 40 and 42. This begins to draw the sides 22 and 24 of the V-shaped opening together. These sides are mated as shown in FIG. 4 and permanently secured together as with any suitable bonding tape, glue, or the like, shown generally at 50. The material is creased along fold lines 26 and 28 thus allowing the front halves 30 and 32 to lie in a single plane. The marginal portions 39 and 46 are folded along lines 40 and 48, respectively, thus allowing the front halves 30 and 32 to lie flat against the remainder of the body. All that needs to be done to completely form the structure is to mate sides 16 and 18 of the floor to corresponding edges 52 and 54 and secure them thereto by means of tape, glue, or any other suitable connecting device. Thus, with the floor so attached, the entire structure lies flat and can be used as a cushion between a sleeper and the ground. Also, in this configuration the structures can be rolled into a compact form which can easily be carried on a standard backpack or can be separately carried, as desired.

Figure 5:
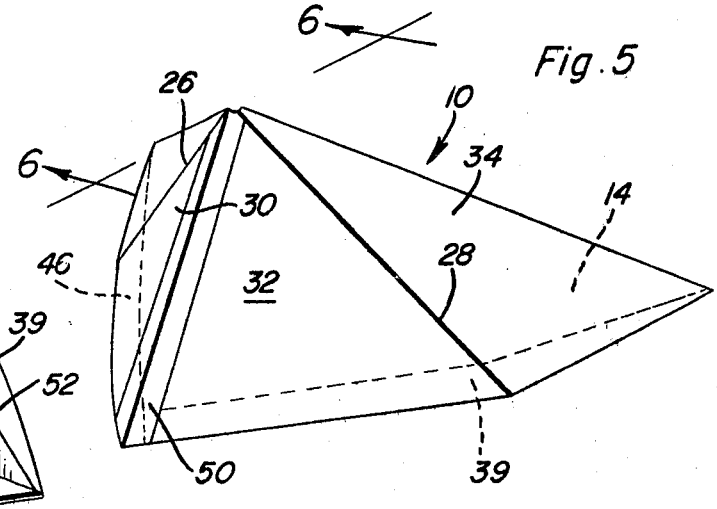
FIG. 5 shows the completed shelter in its erect configuration.
Figure 6:
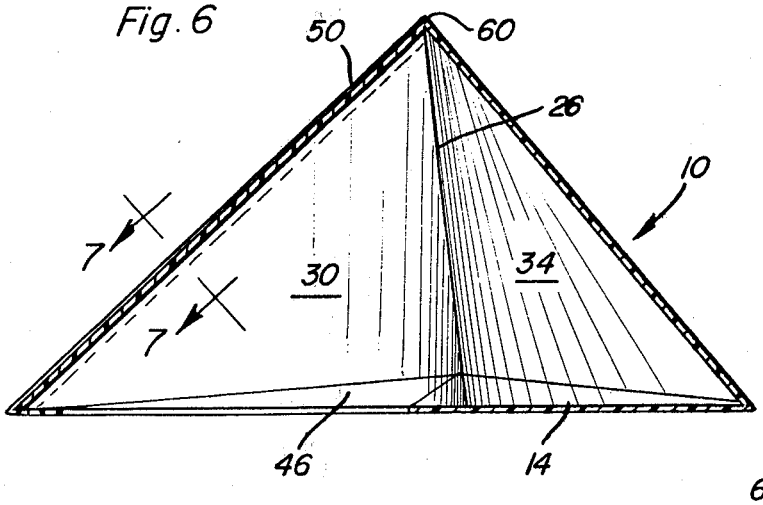
FIG. 6 is a side elevational sectional view taken substantially along the plane passing through section line 6—6 of FIG. 5.
Figure 7:
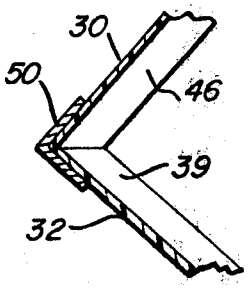
FIG. 7 is a fragmental sectional view taken substantially along the plane passing through section line 7—7 of FIG. 6.

In order to deploy the shelter as shown in FIGS. 5 and 6, the user enters from below and places his weight on the floor section 14 while pushing the front sections 30 and 32 away from him until the marginal portions 39 and 46 rest snug on the ground. This causes the upper section of the top to assume a somewhat conical configuration with the lower peripheral edge assuming a generally triangular shape. The weight of the occupant on the floor holds the peripheral edge of the shelter in contact with the ground and the occupant can sleep in comfort and security with protection from wind, rain, snow, or the like. If desired, stake loops can be attached at the ends of the minor base 20 of the floor section in order to provide a means for more positively holding the shelter in contact with the ground. Furthermore, an opening 60 can be formed in the top of the shelter to allow ventilation.

The structure operates on the principle of a tepee. Air is allowed to be drawn into the floor opening. To reduce or stop drafts, greater downward pressure on the stake loops will seal the opening completely to the ground, if desired. The hole 60 formed in the apex is sufficient for normal ventilation and allows only miniscule amounts of precipitation to enter.

The conical upper structure adds erection strength and the tetrahedronal base gives the occupant a sufficient area in which to sleep, store gear, and set up. In arctic conditions, when erected in deep snow, the shelter has many of the advantages of an igloo when properly trenched with lower floor and tunnel entrance. Furthermore, the clean squat shape reduces wind effects and it can be held in place by body weight without the need for poles.

Figure 8:
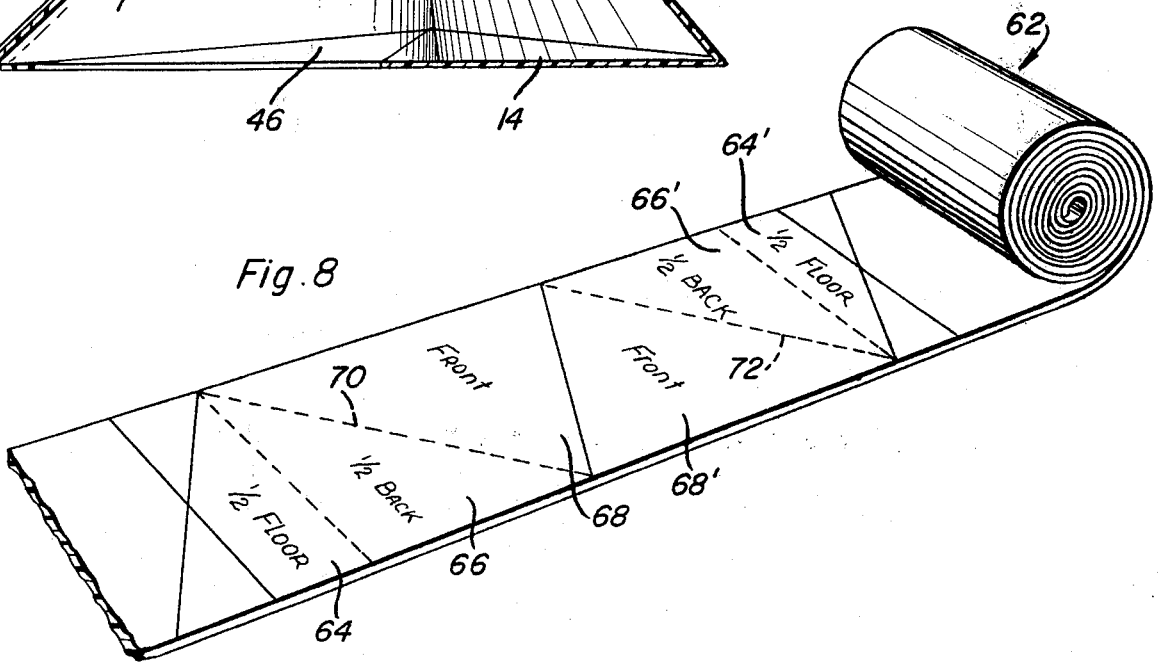
FIG. 8 shows fold lines for producing the shelter from a length of rolled material.

The polyethylene foam preferably used to make the shelter, is normally sold in rolls, such as shown at 62 in FIG. 8. For this reason, a standard 54 inch roll 62 is shown with markings which enable its use in the production of a shelter 10. It will be noted that the shelter formed from the configuration of FIG. 8 would have no marginal flanges such as 39 or 46 of shelter 10 until folded flat. In the drawing, the solid lines indicate lines to be cut, while the dotted lines indicate fold lines. Obviously, two sections each containing one half of the shelter are cut out, folded and permanently bonded together to form the final structure. The half floor sections 64 and 64' are connected after one section is flipped over so as to allow the halves to meet symmetrically. The half back sections 66 and 66' are also mated and permanently bonded. The front sections 68 and 68' are folded along lines 70 and 72, respectively, and their edges are bonded permanently together to form a complete shelter.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A collapsible, portable shelter adapted for use with a backpack, said shelter comprising:

a top portion produced from a flexible, semi-rigid, shape sustaining material and formed in a continuous covering having an upper section and a lower section with the upper section disposed above said lower section and said lower section including a ground contacting peripheral edge;

a floor connected to said ground contacting peripheral edge and having an ingress and egress means formed therein, said ingress and egress means comprising an opening in said floor.

2. The shelter defined in claim 1 wherein said upper section is generally conical in shape.

3. The shelter defined in claim 2 wherein said lower section is generally triangular in plan and said peripheral edge is generally triangular.

4. The shelter defined in claim 2 wherein said conical upper section includes an apex having a vent hole formed therein.

5. The shelter defined in claim 1 and further wherein said floor contains a marginal flange connected to said peripheral edge surrounding said opening.

6. The shelter defined in claim 1 wherein said top portion is divided into a front and a rear section, said front and rear sections being separated by a pair of fold lines extending from the uppermost point of said top portion to said peripheral edge and disposed in relation so that said shelter can be moved between a collapsed mode and an erect mode with said top being folded along said fold lines and disposed adjacent each other in a flat configuration when in said collapsed mode, and said front and back extending divergingly away from said fold lines when in said erect mode.

7. The shelter as defined in claim 3 wherein said floor is trapezoidal in shape with the major basis of trapezoid being disposed coincident with one leg of said triangular peripheral edge and the two sides of said trapezoid being connected directly to the other two legs of said triangular peripheral edge.

8. The shelter as defined in claim 7 and further including stake loops connected to the ends of the minor base of said trapezoidal shaped floor.

9. The shelter as defined in claim 2 and further including a pair of fold lines for disposing the shelter either in erect position or a collapsed position, said fold lines being disposed in a position extending from the apex of said cone to separate positions on said peripheral edge.

* * * * *